US008550535B1

(12) United States Patent
Enck

(10) Patent No.: US 8,550,535 B1
(45) Date of Patent: Oct. 8, 2013

(54) TAPER DOOR CONNECTOR STRATEGY

(75) Inventor: Brian Enck, Sterling Heights, MI (US)

(73) Assignee: International Truck Intellectual Property Company, LLC, Lisle, IL (US)

( * ) Notice: Subject to any disclaimer, the term of this patent is extended or adjusted under 35 U.S.C. 154(b) by 0 days.

(21) Appl. No.: 13/596,584

(22) Filed: Aug. 28, 2012

(51) Int. Cl.
*B60J 5/00* (2006.01)

(52) U.S. Cl.
USPC ..... 296/146.11; 49/449

(58) Field of Classification Search
USPC ..... 296/146.11; 49/322, 449, 503
See application file for complete search history.

(56) References Cited

U.S. PATENT DOCUMENTS

| | | | | |
|---|---|---|---|---|
| 3,041,098 | A * | 6/1962 | Johnson et al. | 292/78 |
| 5,406,814 | A * | 4/1995 | Zeager et al. | 70/102 |
| 7,240,524 | B1 * | 7/2007 | White et al. | 70/257 |
| 7,926,857 | B2 * | 4/2011 | Akizuki et al. | 292/201 |

* cited by examiner

*Primary Examiner* — Lori Lyjak
(74) *Attorney, Agent, or Firm* — Jeffrey P. Calfa; Mark C. Bach

(57) ABSTRACT

A door support assembly for a motor vehicle is described. Generally speaking, the assembly includes a pin with a tapered section and being attached to the vehicle door, a passage with a mating surface for the tapered section fixed to the vehicle, and a latching mechanism configured to pull the vehicle door inward when engaged. When the latch mechanism is engaged, the assembly provides zero-gap with the door frame. The pin is tapered to a degree that it does not become wedged within the passage as the result of an explosive event.

15 Claims, 2 Drawing Sheets

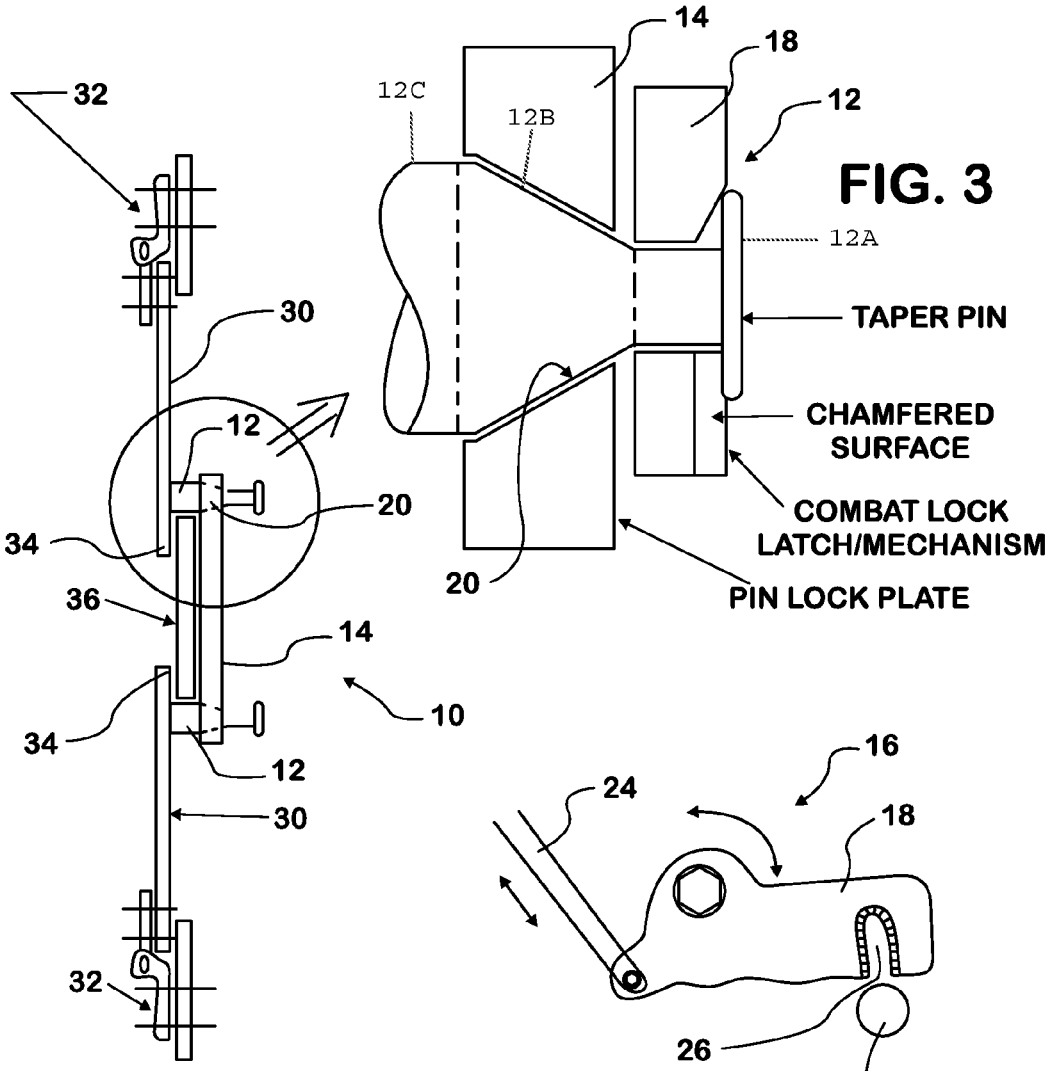
FIG. 3
FIG. 2
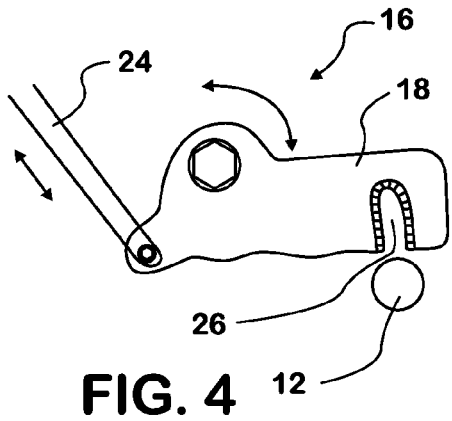
FIG. 4

TAPER DOOR CONNECTOR STRATEGY

TECHNICAL FIELD

The present device and methods relate to door latches. More specifically, the device relates to a door latch which operates during and after a blast event.

BACKGROUND

In any attack on a military vehicle, the primary objective is always the safety of personnel within the vehicle. In furtherance of this objective, the vehicle access points, such as doors, are of critical concern. For example, during a blast event the doors must provide sufficient shielding of vehicle personnel by remaining closed, but also must remain functional to provide immediate exit from the vehicle after the event. Accordingly, door seals should remain intact to prevent gas ingress to the vehicle cabin, and door latches should remain functional to prevent trapping personnel within the vehicle cabin.

The latch of FIG. 1 illustrates a typical combat latching mechanism 50. Several of these combat latches may be located along the edge of a vehicle door with the intention that it acts much like a household deadbolt. That is, if anyone tries to enter, the combat latch mechanism 50 is fixed in place on the vehicle interior and requires mechanical disengagement from the inside to provide passage in or out. These latches are unlike a regular door latch which engages via springs and can be operated from the interior or exterior of the vehicle.

The combat lock mechanism 50 comprises linkage 52 attached to a pivoting paddle 54. The linkage 52 is actuated to rotate the paddle 54 which then engages/disengages with a slot 56 in the door frame when the door is closed, mechanically fixing the door lock.

When an extremely violent blast event occurs, such as an explosion, all of the vehicle door panels are designed to deflect to a point to blunt the blast. However, such deflection can also cause the paddle 54 to disengage with the slot 56 or to becomes bent. If the paddle 54 disengages, the door can open, at least enough to allow gases to enter the cabin. If the paddle 54 bends, it may not readily disengage when the occupants try to evacuate after the event, trapping them inside.

These and other problems are solved by the present device and system by providing a door support assembly capable of withstanding a severe blast event without compromising the safety of the personnel and without hindering egress of that personnel after the event.

SUMMARY

Generally speaking, a vehicle door assembly is described having a vehicle door hinged along a first edge to a vehicle and a door support pin attached to a second edge of the vehicle door. A plate attached to the vehicle adjacent the second edge of the vehicle door and having a passage defined therein which corresponds to and allows a portion of the door support pin to pass there through, works to support the door. Finally, a latch mechanism configured to be manually engaged and disengaged with the portion of the door support pin which passes through the plate completes the assembly.

In an embodiment of the assembly, the passage in the plate has a mating surface which matches the surface of the door support pin. Further, the support pin includes a base attaching the support pin to the door, a tapered section which narrows in a direction opposite the base, and a flange attached at the narrow of the tapered section and extending beyond a diameter of the tapered section. The taper of the tapered section has a ratio in the range from about 1:1 to about 5:1 to prevent binding.

In use, the latch mechanism is configured to engage the flange of the door support pin to pull the door inward when engaged. Accordingly, the latch mechanism has a slot therein and the slot comprises a chamfered surface.

Additional embodiments and features of the system can be understood from the appended drawings and the detailed description below.

BRIEF DESCRIPTION OF THE DRAWINGS

FIG. 2 is a top view of a door support assembly illustrated in accordance with the disclosure;

FIG. 3 is a close-up view of the features of the door support assembly highlighted by the circle of FIG. 2; and FIG. 4 is a side view of the latch mechanism of the present assembly.

DETAILED DESCRIPTION

Figure 1:
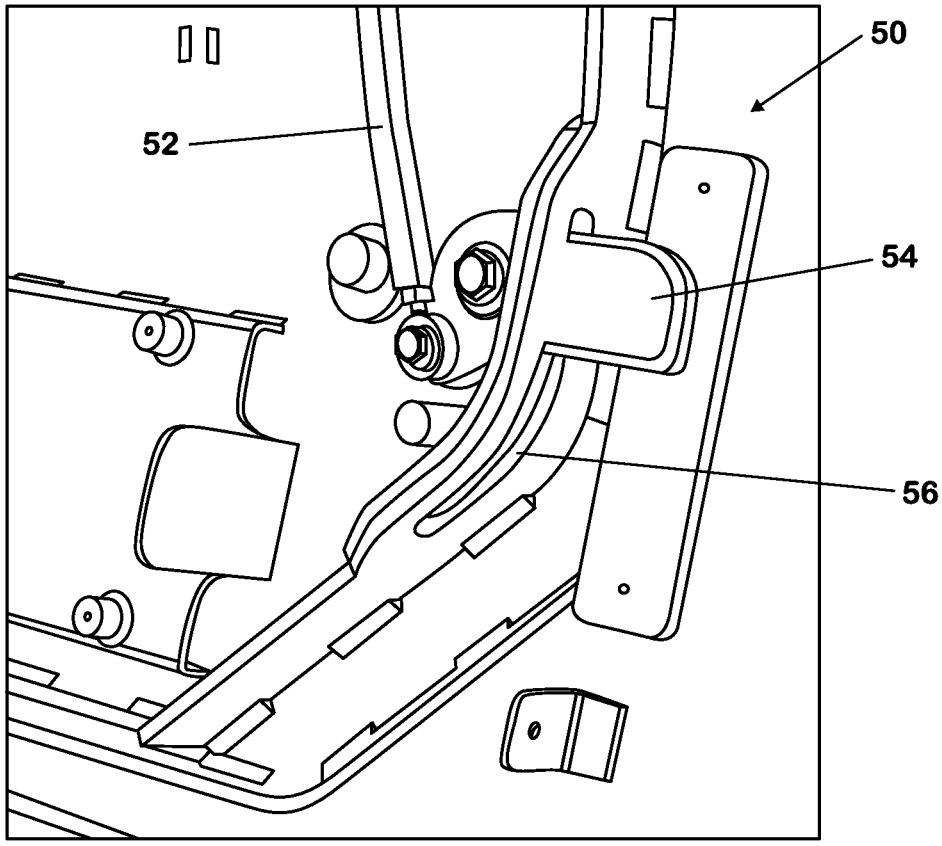
FIG. 1 (PRIOR ART)
FIG. 1 is a side view of a prior art door latching assembly.

With reference to FIGS. 2-4, an embodiment of the door support assembly can be most readily seen and understood. The assembly is generally indicated in the appended drawings by the numeral 10, and assembly components are consistently identified throughout the drawing figures and the following description. While the assembly 10 is described with respect to a military vehicle (not shown), it is understood that the application of the assembly is much broader.

FIG. 2 illustrates a top view of an embodiment of system 10 installed for use on a double-door vehicle. As shown, the assembly 10 operates on a vehicle door 30 hinged along a first edge via at least one high-strength steel hinge 32. The second (or opposing) edge 34 of the door is releasable to allow ingress and egress of personnel, for example. The second edge abuts the vehicle frame/body 36 to which it may be releasably coupled.

The assembly comprises comprising a support pin 12, a lock plate 14 and a latching mechanism 16. The pin 12, which is fixed to the second edge of the door 30, has three sections: a base 12A, a tapered section 12B, and a flanged section 12C. One support pin 12 is sufficient for most applications, though a plurality of pins may be used, if necessary. The pin 12 is made from a high-strength material which resists shearing, elongating, twisting and generally deforming. Likewise, the plate 14 and the latching mechanism 16 are also made from high-strength steel or the like.

As shown in FIG. 3, the plate 14 includes a conical passage 20 which has surfaces to mate with the tapered portion of the pin 12. To prevent binding within the passage 20, the taper of pin 12 should be broad, for example, having a ratio greater than 5:1, and including in the range from 1:1 to about 5:1. The plate 14, once positioned to align the passage 20 with the support pin 12, is affixed to the vehicle body or sidewall 36.

The latching mechanism 16 may operate and be used much like the combat lock mechanism 50 of FIG. 1. That is, the latching mechanism 16 works as a dead-bolt for the door 30, to be engaged when in combat or similar situations. The latching mechanism 16 may be engaged and disengaged via linkage 24 responsive to a mechanical lever (not shown). The latching mechanism 16 includes a latch 18 having a slotted opening 26. The slotted opening 26 has a chamfered surface which draws the pin 12 inward as it is engaged.

In use, the vehicle door 30 is closed pivoting at the hinged edge 32 until the second edge 34 contacts the vehicle sidewall 36. The support pin 12 passes through the passage 20 of the plate 14 fixed on the interior of the vehicle sidewall 36. When desired, the latch 18 of the latching mechanism 16 may be rotated to engage the slotted opening 26 (FIG. 4) with the support pin 12 just below the flanged end. The chamfered surface of the slotted opening 26 pulls the pin 12 inward to nest the tapered section within the conical passage 20 of the plate 14. To unlatch the latching mechanism 16 the latch 18 rotation is reversed. Once disengaged, the vehicle door 30 may be opened for ingress or egress.

What is claimed is:

1. A vehicle door assembly comprising:

a vehicle door hinged along a first edge to a vehicle;

a door support pin attached to a second edge of the vehicle door;

a plate attached to the vehicle adjacent the second edge of the vehicle door and having a passage defined therein which corresponds to and allows a portion of the door support pin to pass there through; and a latch mechanism configured to be manually engaged and disengaged with the portion of the door support pin which passes through the plate.

2. The vehicle door assembly of claim 1, wherein the passage in the plate has a mating surface which matches the surface of the door support pin.

3. The vehicle door assembly of claim 1, wherein the support pin comprises:

a base attaching the support pin to the door;

a tapered section which narrows in a direction opposite the base; and a flange attached at the narrow of the tapered section and extending beyond a diameter of the tapered section.

4. The vehicle door assembly of claim 3, wherein the plate has a thickness substantially equal to a length of the tapered section of the door support pin.

5. The vehicle door assembly of claim 1, wherein the latch mechanism is configured to pull the door support pin inward to a support frame when engaged.

6. The vehicle door assembly of claim 3, wherein the latch mechanism is configured to engage the flange of the door support pin to pull the door inward when engaged.

7. The vehicle door assembly of claim 5, wherein the latch mechanism has a slot therein and the slot comprises a chamfered surface.

8. The vehicle door assembly of claim 1, wherein the pin is comprised of a high-strength material.

9. The vehicle door assembly of claim 3, wherein the pin is comprised of a high-strength material.

10. The vehicle door assembly of claim 3, wherein thea taper has a ratio in the range from about 1:1 to about 5:1.

11. The vehicle door assembly of claim 3, wherein thea taper has a ratio greater than 5:1.

12. A method for maintaining operability of a vehicle access door in response to a blast event, the method comprising the steps of:

affixing at least one door support pin to a non-hinged edge of the door;

attaching a plate to the vehicle, the plate having at least one passage defined thereon, with each passage corresponding to and allowing a portion of a door support pin to pass there through;

latching an end of the door support pin which passes through the passage;

wherein the support pin moves the door with the plate in response to a blast event.

13. The method of claim 12, wherein the support pin comprises:

a base attaching the support pin to the door;

a tapered section which narrows in a direction opposite the base; and a flange attached at the narrow of the tapered section and extending beyond a diameter of the tapered section.

14. The method of claim 13, wherein the step of latching the end of the door support pin comprises the step of pulling the tapered section of the pin into engagement with the passage of the plate.

15. The method of claim 14, wherein the tapered section has a ratio of greater than 5:1.

* * * * *